United States Patent [19]

Silver

[11] Patent Number: 4,771,479

[45] Date of Patent: Sep. 20, 1988

[54] ARTICLE OF CLOTHING

[76] Inventor: Irwin Silver, 350 Fifth Ave., New York, N.Y. 10001

[21] Appl. No.: 927,853

[22] Filed: Nov. 6, 1986

[51] Int. Cl.[4] ..... A41D 3/02

[52] U.S. Cl. ..... 2/85; 2/93; 2/207; 2/249; 2/250

[58] Field of Search ..... 2/85, 86, 87, 91, 108, 2/203, 207, 249, 250, 93

[56] References Cited

U.S. PATENT DOCUMENTS

| | | | |
|---|---|---|---|
| 549,829 | 11/1895 | Shrier | 2/108 |
| 1,629,840 | 5/1927 | Rolnick | 2/91 |
| 1,936,045 | 11/1933 | Bachrach | 2/91 |
| 3,031,677 | 5/1962 | Murphy | 2/91 X |
| 4,034,417 | 7/1977 | Ellis | 2/108 X |
| 4,220,299 | 9/1980 | Motter | 2/250 X |
| 4,351,066 | 9/1982 | Pearsall | 2/85 |
| 4,569,089 | 2/1986 | Nesse | 2/108 |

FOREIGN PATENT DOCUMENTS

| | | | |
|---|---|---|---|
| 84987 | 8/1983 | European Pat. Off. | 2/108 |
| 323430 | 1/1930 | United Kingdom | 2/91 |

*Primary Examiner*—Ronald Feldbaum

*Attorney, Agent, or Firm*—McAulay, Fields, Fisher, Goldstein & Nissen

[57] ABSTRACT

A clothing article surrounds a wearer's upper torso. The article includes connected front and back portions, a collar, and sleeves. A pocket is formed in the back portion. The pocket has a closable opening which is spaced from the upper edge. A scarf is connected to the upper inner portion of the pocket. The pocket is shaped and dimensioned to neatly receive the scarf in folded condition when the wearer does not desire to use the scarf. The scarf is easily removable through the pocket opening so that it can be unfolded and worn around a wearer's neck.

7 Claims, 3 Drawing Sheets

ARTICLE OF CLOTHING

BACKGROUND OF THE INVENTION

1. Field of the Invention

The invention relates generally to a clothing article, and more particularly to an article of outerwear having a scarf connected permanently thereto.

2. Description of the Prior Art

Outerwear articles, such as jackets, coats, and sweaters, are generally designed to be protective, comfortable, and attractive. Most such articles include front panels, a back panel, sleeves and a collar. However, certain garments, such as ski wear, also are provided at times with accessories such as hoods attached thereto so that a user may elect to wear or not wear the hood depending on weather conditions. In the case of ski wear, the attached hood is connected to the outside of the garment and hangs down the back panel in superposed position when not in use.

However, an entirely different problem is presented where the accessory is of substantial length, such as a scarf. Morever, the problem is compounded when the garment is for a child. Thus, if the scarf is attached to the jacket, it will hang down and is capable of being caught in doors, pulled, caught on coat hooks, etc. On the other hand, a loose scarf or muffler is susceptable of being lost.

Accordingly, it is an object of the present invention to provide an improved article of clothing.

A further object of the invention is the provision of an article of clothing that is attractive in appearance and comfortable to wear.

Another object of the prevent invention is to provide an article of clothing having an attached scarf that is compactly received within the garment when not in use.

BRIEF DESCRIPTION OF THE INVENTION

In keeping with these objects, and others which will become apparent hereinafter, one feature of the present invention resides in an outerwear article adapted to surround at least the upper body of a wearer. The article has connected front and rear portions. The rear portion is formed with a pocket having a closable opening. The pocket opening is spaced from the upper edge of the back portion. A scarf is provided which is sewn to the upper inner portion of the pocket. The pocket is shaped and dimensioned to neatly receive the scarf in folded condition when the wearer does not desire to use the scarf. The scarf is easily removed from the pocket through the pocket opening so that it can be unfolded and worn around a wearer's neck.

The novel features which are characteristic of the invention are set forth in particular in the appended claims. The invention itself, however, both as to its construction and its method of operation, together with additional objects and advantages thereof, will best be understood from the following description of the specific embodiments when read in connection with the accompanying drawings.

DETAILED DESCRIPTION OF THE PREFERRED EMBODIMENTS

Figure 1:
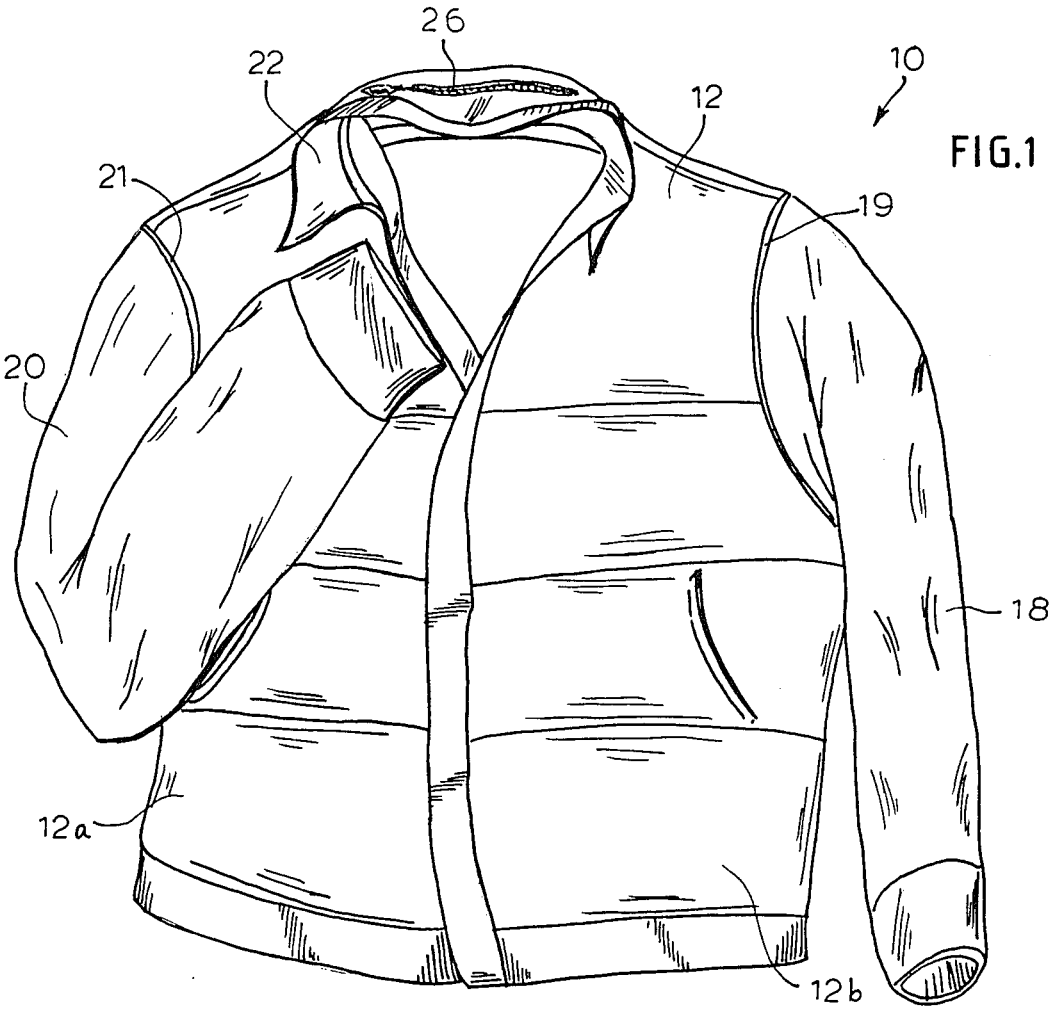
FIG. 1 is a perspective view of a jacket made in accordance with the present invention.
Figure 5:
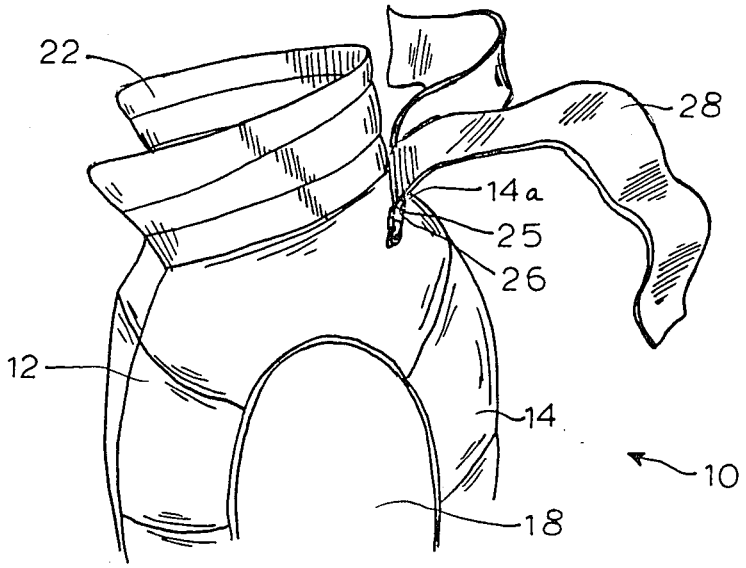
FIG. 5 is a side elevational view of the upper portion of the jacket showing the elements when the scarf is out of the pocket.
Figure 2:
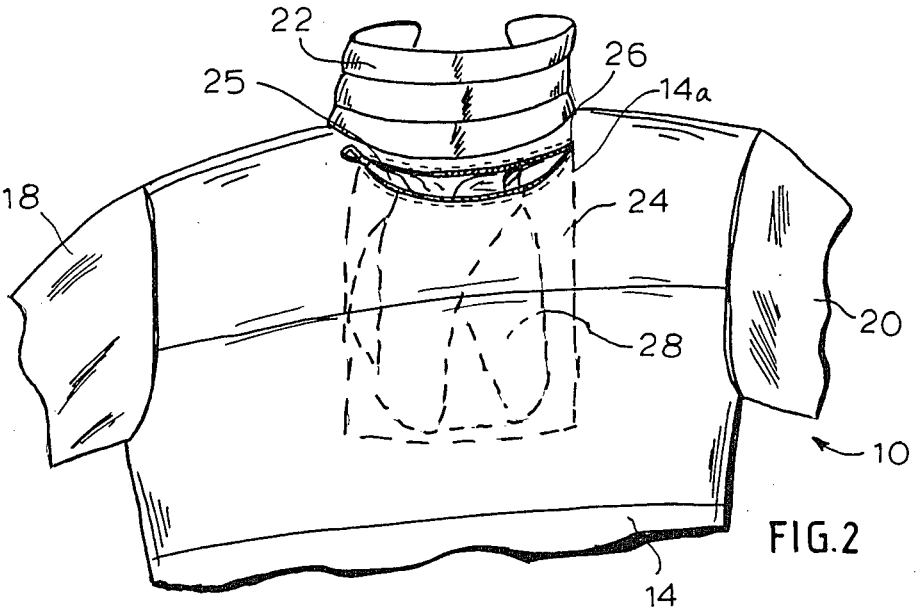
FIG. 2 is a partial view of the jacket showing the scarf in folded condition in the pocket.
Figure 3:
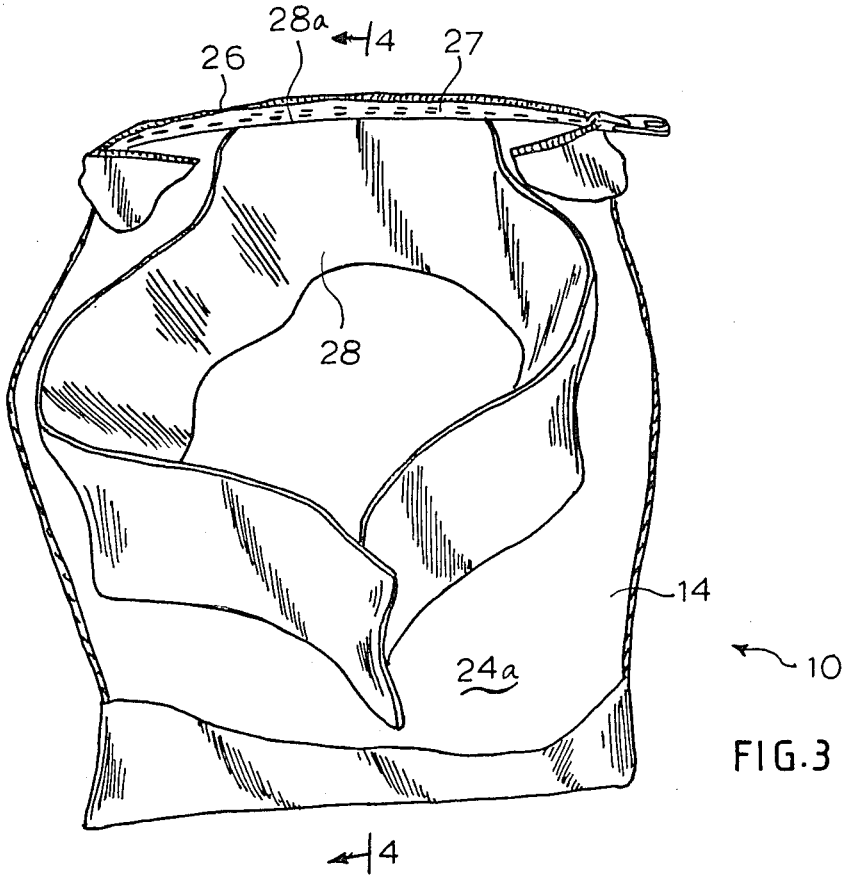
FIG. 3 is an enlarged detail view of the interior of the scarf pocket, showing the scarf retained in the pocket.
Figure 6:
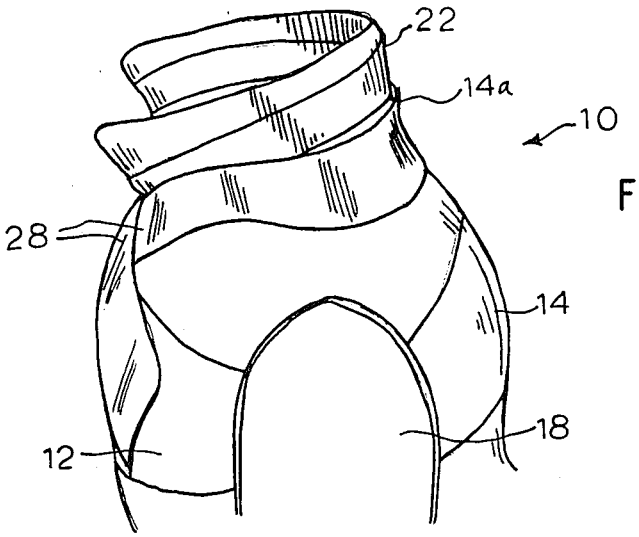
FIG. 6 is a view similar to FIG. 5 showing the jacket when the scarf is in the pocket.
Figure 4:
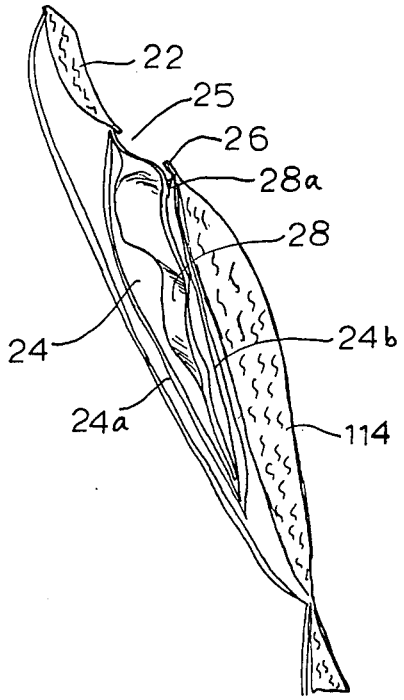
FIG. 4 is a sectional view taken along line 4—4 of FIG. 3.

A jacket constructed according to the present invention is designated generally by the reference character 10 in the figures. Although a jacket is shown, any outerwear article which surrounds at least the upper body of a wearer may be used in accordance with the teachings of this invention.

Jacket 10 has a front portion 12 connected to a back or rear panel portion 14. The front portion 12 includes two front panels **12*a* and 12*b* connectable to one another by a front zipper (not shown) or other appropriate closure mechanism so that jacket 10** may be worn closed or open, depending upon weather conditions.

Jacket 10 includes two sleeves 18 and 20 and the collar 22. The sleeves may be permanently attached to the arm holes 19 and 21 or may be made detachable.

A pocket 24 is provided in rear panel 14. Pocket 24 has an opening 25 spaced below the upper edge **14*a* of the back portion. The pocket 24, comprising panels 24*a*, 24*b* sewn together along three edges, extends downwardly from the opening. Pocket 24 is provided with a zipper 26 or other closure mechanism for selectively opening or closing opening 25. Pocket 24** may be unlined or lined with a waterproof material or the like. Although the pocket is shown on the outer surface of rear panel, the pocket may also be placed on the inner surface for aesthetic reasons or the like.

The mid-section of a scarf 28 is sewn along one edge **28*a* to the upper portion 27 of pocket 24. In a preferred embodiment, scarf 28 matches sleeves 18 and 20 so that jacket 10** has a coordinated look. That is, the scarf and sleeves may be fabricated from the same material.

The packet 24 is shaped and dimensioned so that the scarf 28 can be neatly retained therein in a folded condition when the user does not desire to wear the scarf. When the user desires to wear the scarf about his neck, he can unzip pocket zipper 26 and easily remove scarf 28 from pocket 24 through the opening 25. Since scarf 28 is securely sewn to jacket 10 it cannot be accidently lost.

Because the scarf 28 neatly fits into pocket 24 when not in use, jacket 10 always retains a neat, uncluttered and attractive look.

It will be understood that each of the elements described above, or two or more together, may also find useful application in other types of constructions from the types described above.

While the invention has been illustrated and described as embodied in a jacket having an attached scarf matching its sleeves, it is not intended to be limited to the details shown, since various modifications and structural changes may be made without departing in any way from the spirit of the invention.

What is claimed:

1. An outerwear jacket suitable for use in cold weather and adapted to surround at least the upper body of the wearer comprising a back portion connected to a front portion, said front portion having a pair of front edges defining a front opening, fastening means on said front portion for fastening together said pair of front edges to close said jacket, said back and front portions each having upper edges, a pair of sleeves connected to said front and back portions, a collar fastened to said upper edges along a collar seam, a pocket in said back portion having an opening spaced below said collar seam and extending downwardly therefrom, a scarf having lateral and longitudinal edges received in said pocket in a folded condition and adapted to be removed from said pocket through said pocket opening and unfolded to be worn about the neck of the wearer, and connecting means adjacent a longitudinal edge of said scarf and the interior of said pocket for connecting together said pocket and said scarf, whereby the entire scarf may be received in said pocket to permit closure of said opening, said connecting means comprising at least a line of stitches spaced inwardly a substantial distance from the lateral edges of said scarf, said line of stitches being the only point of connection between said scarf and said jacket, whereby the end of said scarf remaining free to be wrapped around the neck when used by the wearer.

2. The clothing article of claim 1, wherein said pocket includes a closure means comprising a zipper.

3. The clothing article of claim 1, wherein said pocket is lined with a waterproof material.

4. The clothing article of claim 1, wherein said pocket is unlined.

5. The clothing article of claim 1, wherein said scarf is fabricated from the same material as said sleeves.

6. The clothing article of claim 1, wherein said pocket opening is located on the outer surface of said back portion.

7. The clothing article of claim 1, wherein said pocket opening is located on the inner surface of said back portion.

* * * * *